US006710277B1

(12) United States Patent
Wong

(10) Patent No.: US 6,710,277 B1
(45) Date of Patent: Mar. 23, 2004

(54) ELECTRICAL SWITCH

(75) Inventor: Kin Yu Wong, Chaiwan (HK)

(73) Assignee: Defond Manufacturing Limited, Chaiwan (HK)

( * ) Notice: Subject to any disclaimer, the term of this patent is extended or adjusted under 35 U.S.C. 154(b) by 0 days.

(21) Appl. No.: 10/320,460

(22) Filed: Dec. 17, 2002

(51) Int. Cl.[7] ..... H01H 13/14
(52) U.S. Cl. ..... 200/520; 200/523
(58) Field of Search ..... 200/520, DIG. 42, 200/523, 325, 529, 533, 534, 535, 6 R, 6 B, 440, 441

(56) References Cited

U.S. PATENT DOCUMENTS 5,164,561 A * 11/1992 Schaeffeler et al. ..... 200/302.2
5,651,452 A * 7/1997 Schaeffeler et al. ..... 200/437

* cited by examiner

*Primary Examiner*—Michael Friedhofer
*Assistant Examiner*—Lisa Klaus
(74) *Attorney, Agent, or Firm*—Leydig, Voit & Mayer, Ltd.

(57) ABSTRACT

An electrical switch comprising a casing, a fixed contact and a moving contact, and an actuator supported for movement to a first position thereby moving the moving contact into contact with the fixed contact. The actuator is movable to a second position for permitting the moving contact to move out of contact from the fixed contact. Resilient means biases the moving contact out of contact from the fixed contact. The switch includes a remover having a part provided adjacent the fixed contact and movable by the actuator moving to the second position for removing the moving contact from the fixed contact in case the moving contact stays in contact with the fixed contact.

11 Claims, 3 Drawing Sheets

ELECTRICAL SWITCH

BACKGROUND OF THE INVENTION

An electrical switch of the kind concerned typically has a casing, a fixed contact and a moving contact, and an actuator for moving the moving contact into contact with the fixed contact. The actuator is movable to an opposite position for permitting the moving contact to move out of contact from the fixed contact under the action of a spring.

In a faulty situation, the moving contact may be hindered from departing from the fixed contact while the switch is intended to be opened. This may occur, particularly but not exclusively, when the load current is large and the two contacts are welded together as a result of arcing and/or flashover across them.

The invention seeks to provide an improved electrical switch of this type in general.

SUMMARY OF THE INVENTION

According to the invention, there is provided an electrical switch comprising a casing, a fixed contact and a moving contact in the scaning, and an actuator supported by the casing for movement to a first position thereby moving the moving contact into contact with the fixed contact. The actuator is movable to a second position for permitting the moving contact to move out of contact from the fixed contact. Resilient means biases the moving contact out of contact from the fixed contact. The switch includes a remover having a part provided adjacent the fixed contact and movable by the actuator moving to the second position for removing the moving contact from the fixed contact in case the moving contact stays in contact with the fixed contact.

Preferably, the remover part is provided on the same side as the fixed contact relative to the moving contact for pushing the moving contact away from the fixed contact.

It is preferred that the remover is supported for sliding movement to remove the moving contact from the fixed contact.

It is further preferred that the electrical switch includes a pivotal member provided between the actuator and the remover for pivoting by the actuator to slide the remover.

In a preferred embodiment, the electrical switch includes a contact lever having a first end about which the lever is pivotably supported and an opposite second end supporting the moving contact. The remover part is arranged to act upon the second lever end for removing the moving contact from the fixed contact.

More preferably, the remover part faces the moving contact as the fixed contact and is slidable in a direction substantially perpendicular to the contact lever for hitting its second end to push the moving contact away from the fixed contact.

More preferably, the electrical switch includes a pivotal member provided between the actuator and the remover for pivoting by the actuator to move the remover, the pivotal member extending substantially parallel to the contact lever.

More preferably, the electrical switch includes a pivotal lever having a first end for pivoting by the actuator and a second end for moving the remover. The actuator includes a slider slidable by the actuator through a cam action, and the slider is positioned between the first ends of the contact lever and the pivotal lever.

Further more preferably, the actuator includes an inclined slot through which the slider extends at substantially right angles, such that the slider will be slid by the actuator through a cam action in a direction substantially perpendicular to the direction in which the actuator moves.

In a specific construction, the resilient means comprises a first spring biassing the actuator towards its second position and a second spring biassing the moving contact away from the fixed contact.

As an example, the electrical switch is a normally-open pushbutton switch.

BRIEF DESCRIPTION OF DRAWINGS

The invention will now be more particularly described, by way of example only, with reference to the accompanying drawings, in which:

FIG. 4 is a cross-sectional side view of the switch of FIG. 1 in a closed condition i.e. switched on.

DETAILED DESCRIPTION OF PREFERRED EMBODIMENT

Figure 1:
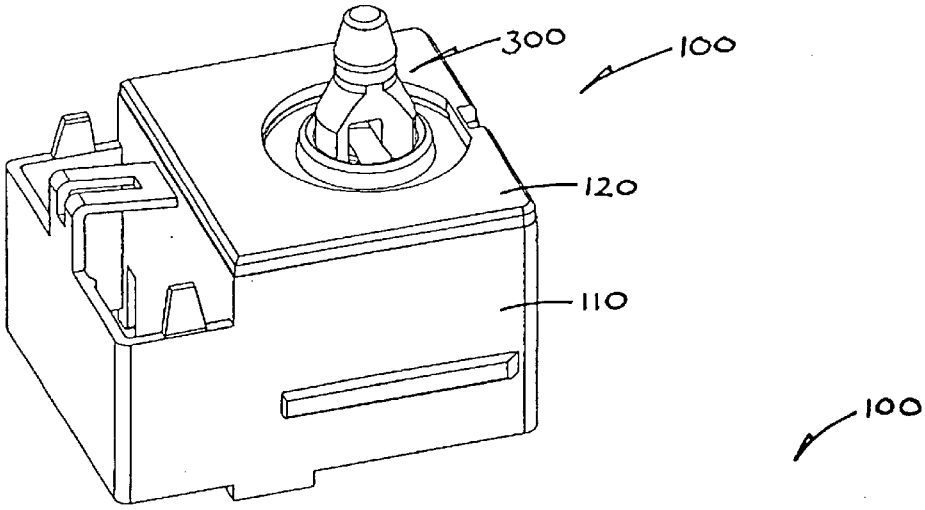
FIG. 1 is a perspective view of an embodiment of an electrical switch in accordance with the invention.

Referring to the drawings, there is shown an electrical switch in the form of a pushbutton switch 100 embodying the invention. The switch 100 has a rectangular box-like plastic casing 110 including an open top side sealed by a plastic lid 120, which contains a pair of left and right switching mechanisms 210 operated by a single pushbutton actuator 300. Each mechanism 210 is associated with a pair of switch terminals 410 and 420 and includes a moving contact lever 500 for making and breaking electrical connection between the two terminals 410 and 420, together constituting a switch unit 200. The terminals 410 and 420 are located on opposite front and rear sides of the casing 110, and the contact lever 500 inside the casing 110.

Each switch unit 200 includes a plastic frames 220 that supports components of the corresponding switching mechanism 210, and the two frames 220 are located side-by-side within the casing 110. Only one switch unit 200 is shown in the drawings and described herein for clarity, while the other unit 200 is simply a mirror image thereof in terms of design and construction.

The first terminal 410 has a vertical limb 412 lying on a front wall 112 of the casing 110, and a horizontal limb 414 that extends from a lower end of the first limb 412 to underlie a casing bottom wall 113. The horizontal limb 414 turns upwards into the casing 110 and in there it mounts, at its free end on the bottle wall 113, a vertical fixed contact plate 416 facing rearwards.

The second terminal 420 has a vertical limb 422 located within a double rear wall 114 of the casing 110, and a horizontal limb 424 that extends from a U-turned upper end of the first limb 422 into the casing 110. The free end of the limb 424 terminates into a horizontal palm 426 that lies on a lower platform 222 of the support frame 220. The palm 426 has a cutout 427 and a pair of bottom recesses 428 an opposite sides of the cutout 427. The platform 222 is situated immediately above the fixed contact plate 416.

The contact lever 500 extends generally upright, having a bifurcate upper end or portion 502 and including a lower end 504 that supports a moving contact knob 506 for movement into and out of contact with the fixed contact plate 416 to perform a switching action. The contact lever 500 is supported for pivotal movement by a generally upright copper lever holder 510, which is in turn hinged by the palm 426 of the second terminal 420 for simultaneous pivotal movement, both about a horizontal axis.

The lever holder 510 has a T-shaped lower end 512, and includes a trifurcate upper end providing a pair of left and right side fingers 514 bent through 90° outwards and a straight middle finger 516 pointing upwards. The crooked fingers 514 have respective notches engaging the contact lever 500 by its upper end 502, whereby the lever holder 510 hingedly supports the contact lever 500. The T-shaped lower end 512 is anchored through the cutout 427 by the recesses 428 of the palm 426, whereby the lever holder 510 is hinged to the palm 428.

Figure 3:
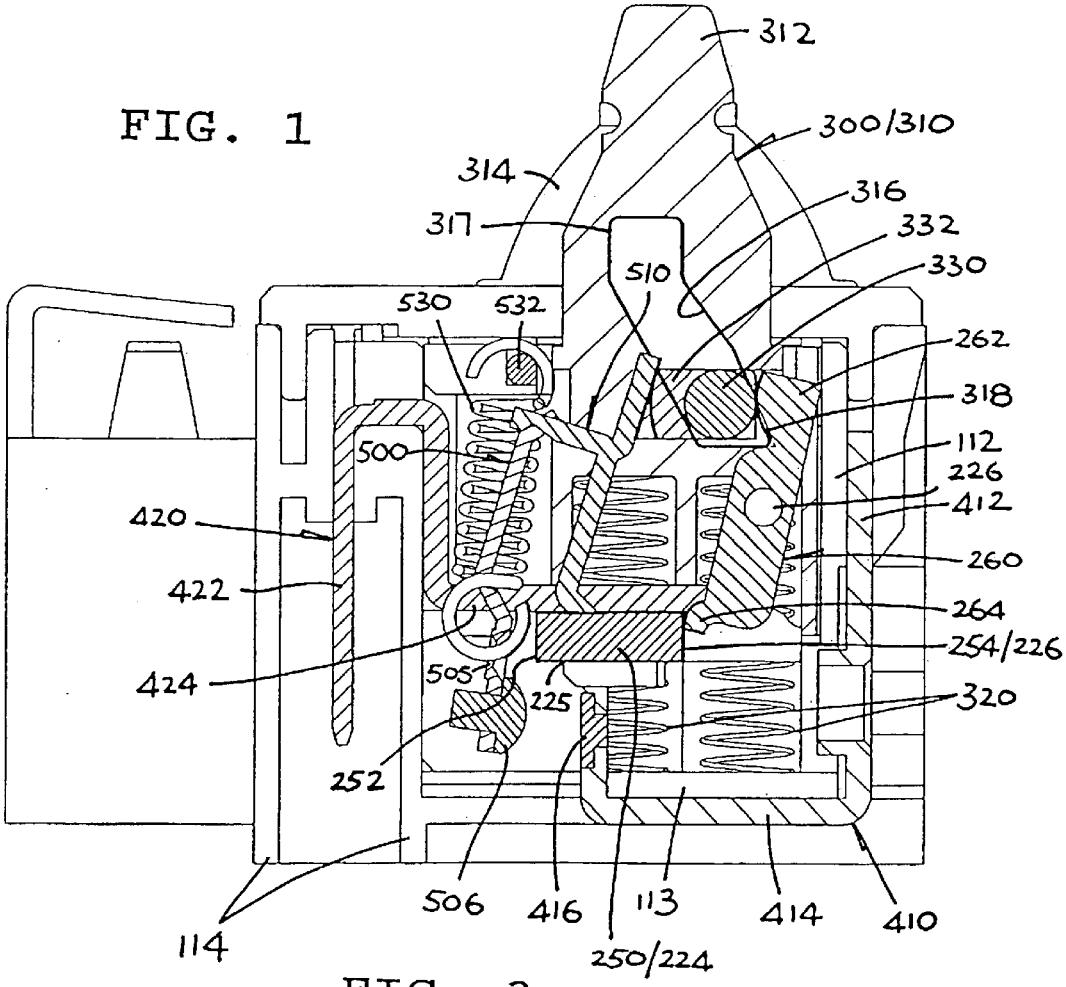
FIG. 3 is a cross-sectional side view of the switch of FIG. 1 in an open condition i.e. switched off.
Figure 2:
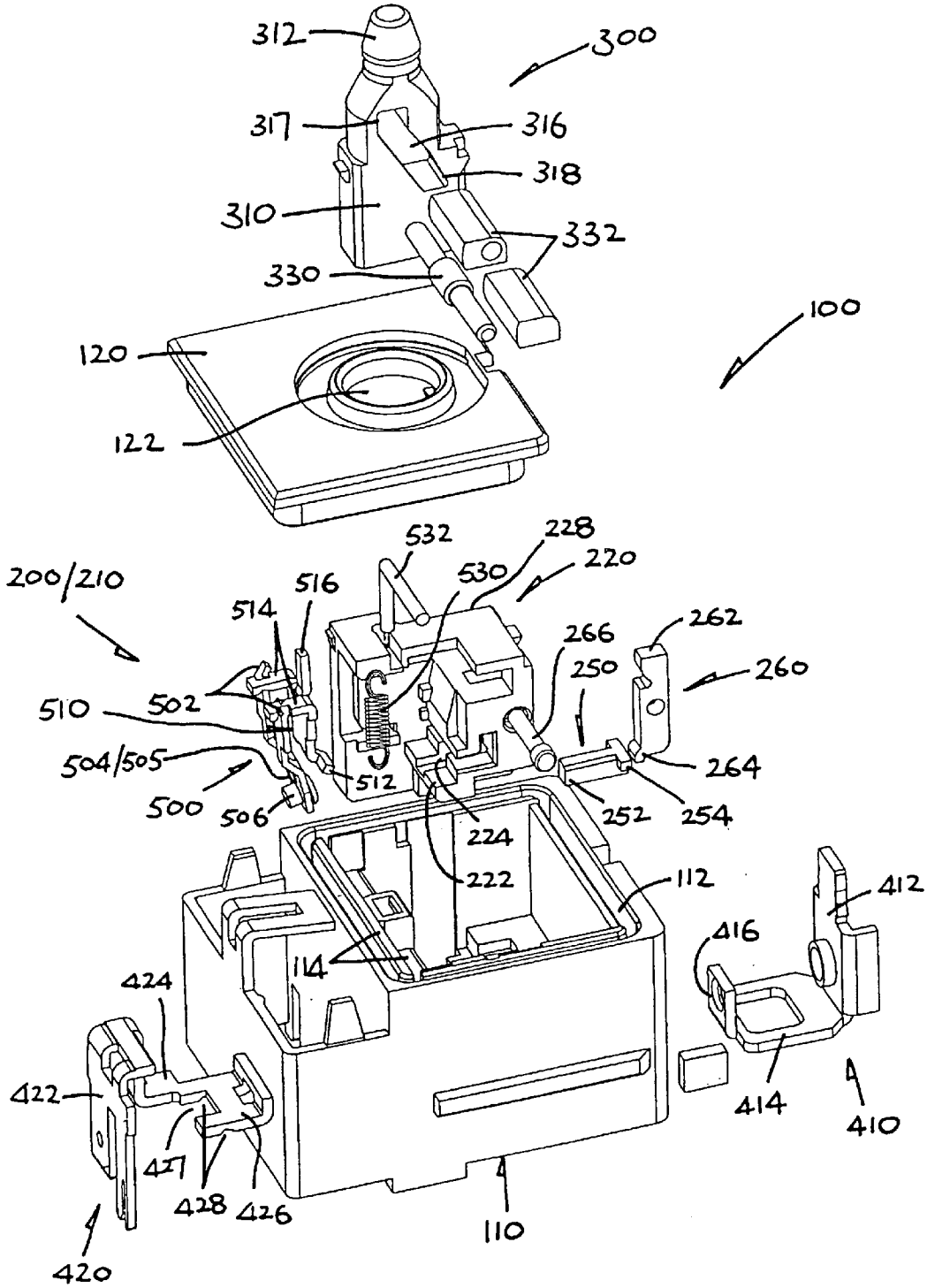
FIG. 2 is an exposed perspective view the switch of FIG. 1, showing all its components.

The contact lever 500 lies alongside in front of the lever holder 510, and an extension coil spring 530 co-extends with the contact lever 500 through its the upper portion 502. The spring 530 is stretched across the lower end 504 of the contact lever 500 and an upper pin 532 of the support frame 220, thereby holding the contact lever 500 and in turn the lever holder 510 in position, while the latter is anchored to the palm 426. The spring 530 is hooked at its lower end to a small hole 505 of the contact lever end 504 immediately above the contact knob 506. In particular, the spring 530 resiliently biasses the contact lever 500 into an inclined stable position (FIG. 3).

Figure 4:
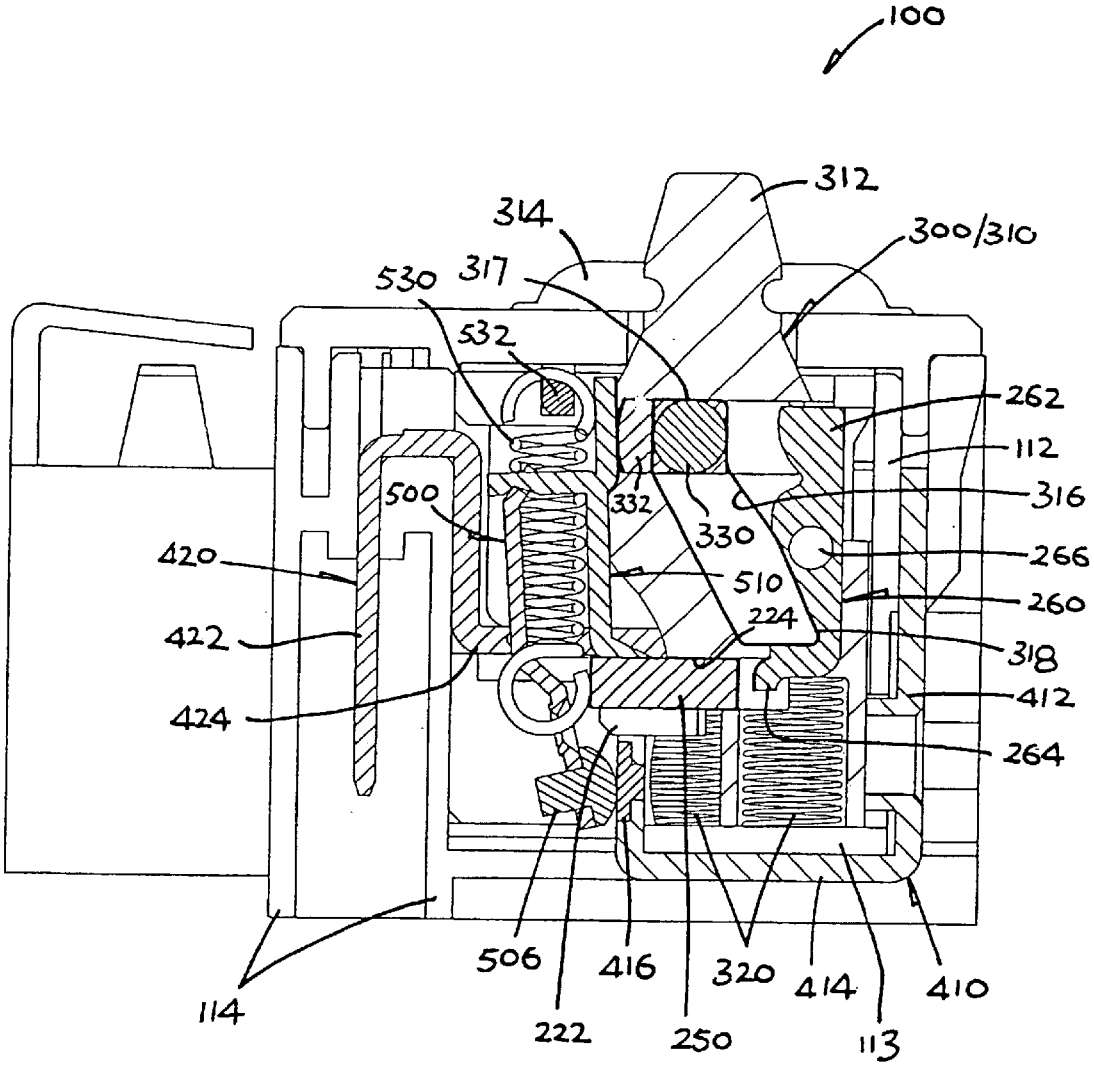

While the lever holder 510 is hinged about the palm 426 below it, its upper end fingers 514 may be pivoted to swing the upper end 502 of the contact lever 500 about generally its lower end 504 from the stable position to a less inclined second position (FIG. 4). As the spring 530 is stretched longer given that the second position is less inclined, this position is unstable. The lever holder 510 is to be pivoted by the actuator 300 acting upon its upper middle finger 516 (as hereinafter described). Upon release of the lever holder 510, the spring 530 reacts to return the contact lever 500 to the stable position.

In the stable position (FIG. 3), the moving contact knob 506 separates from the fixed contact plate 416, whereby the switch unit 200 is normally open (switched off). In the second position (FIG. 4), the moving contact knob 506 bears against the fixed contact plate 416, whereby the switch unit 200 is closed (switched on).

The actuator 300 has a plastic body 310 sandwiched by the two support frames 220, which is resiliently biassed upwards by a pair of compression coil springs 320 also between the frames 220. The body 310 protrudes out of the lid 120 through an aperture 122 thereof, and has an uppermost end 312 to which a press knob (not shown) is snapped on. The space between the end 312 and the aperture 122 is sealed off by a frusto-conical rubber bellow 314 for dust protection. The body 310 is formed with an inclined slot 316 as shown, which has upper and lower ends 317 and 318.

The actuator 300 includes a horizontal rod 330 inside the support frames 220, which extends through the slot 316 at right angles and whose opposite ends carry a pair of knobs 332 disposed thereon. The rod 330 is slidable sideways back-and-forth along a linear passage 228 formed by a pair of opposed horizontal tracks inside the frames 220. There is a cam action between the rod 330 and the slot 316, which causes the rod 330 to slide rearwards (to the right in FIG. 3) or forwards (to the left in FIG. 4) when the body 310 is lifted by the springs 320 or lowered upon depression respectively.

The upper end middle finger 516 of the lever holder 510 is positioned in front of and aligned with the corresponding knob 332 of the rod 330. When the rod 330 slides forwards, each of its knobs 332 will pivot the corresponding lever holder 510 by pushing its upper middle finger 516, thereby closing both switch units 200. Upon rearward sliding of the rod 330, its two knobs 332 will release the corresponding lever holders 510, thereby allowing both switch units 200 to return to the normally-open condition.

The platform 222 includes a central tunnel 224 which has front and rear ends 225 and 226 and extends horizontally from back to front through the support frame 220. The tunnel front end 225 is positioned adjacent and immediately above the fixed contact plate 416, together facing the moving contact knob 506.

A plunger 250 is received in the tunnel 224 for sliding movement therealong. Immediately behind the plunger 250, a generally upright kick lever 260 is hinged at mid-length by a horizontal pin 266 of the support frame 220 for pivotal motion. The lever 260 has upper and lower ends 262 and 264 and is provided between the actuator 300 and the plunger 250.

The upper lever end 262 is positioned behind and aligned with the corresponding knob 332 of the rod 330, for movement by the knob 332 when the rod 330 slides rearwards (to the right in FIG. 3) during opening of the switch unit 200, whereby the lever 260 is pivoted. The lower lever end 264 is aligned with the rear plunger end 254 for kicking the plunger 250 forwards to protrude its front end 252 out of the front tunnel end 225, or to protrude it further out, simultaneously upon said pivoting of the lever 260.

The rear plunger end 254 is enlarged to stop the plunger 250 over protruding from the tunnel end 225. Upon closing of the switch unit 200, the knob 332 slides forwards (to the left in FIG. 4) away from the upper lever end 262, whereby the lever 262 and in turn the plunger 250 is released. While the plunger 250 is free (to a limited but sufficient extent), it will not obstruct pivoting close of the contact lever 500.

The front tunnel end 225 is positioned on the same side as the contact plate 416 relative to the contact knob 506 such that the associated plunger end 252 faces or points at the contact lever 500. The plunger end 252 will, upon protruding, reach out to the position where the small hole 505 of the contact lever 500 was previously. In normal circumstances, given that the lower end 504 of the contact lever 500 will simultaneously be leaving this position under the action of the spring 530, the plunger end 252 will not hit or touch the lever 500 (FIG. 3).

The plunger 250 acts as a contact remover and is deployed as a safety measure for action in a faulty situation during intended opening of the switch unit 200, where the contact lever 500 is hindered from pivoting its contact knob 506 away from the fixed contact plate 416. This may occur, particularly but not exclusively, when the load current is large and the two contact members 506 and 416 are welded together by arcing and/or flashover across them. The plunger 250 is useful to hit the contact lever 500 in the region of its lower end small hole 505, or the lower end of the spring 530 engaged thereat, thereby striking off or removing the contact knob 506 from the contact plate 416.

It is important to note that the precise form of the contact remover 250, including the lever 260 therefor, is not essential. For example, these two components may be replaced by a single lever, or a simple linkage, arranged to transmit the self-return movement of the actuator 300 to the moving contact 500/506. Also, the contact remover 250 may act upon the moving contact 500/506 from behind, i.e. pulling instead of pushing.

In general, the subject electrical switch may not need to be a pushbutton switch and can be, for example, a rocker or toggle switch. It is also not necessarily a normally-open switch.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a casing;

a fixed contact and a moving contact in the casing;

an actuator supported by the casing for movement to a first position thereby moving the moving contact into contact with the fixed contact, the actuator being movable to a second position for permitting the moving contact to move out of contact from the fixed contact;

resilient means biassing the moving contact out of contact from the fixed contact; and a remover having a part provided adjacent the fixed contact and movable by the actuator moving to the second position for removing the moving contact from the fixed contact in case the moving contact stays in contact with the fixed contact.

2. The electrical switch as claimed in claim 1, wherein the remover part is provided on a same side as the fixed contact relative to the moving contact for pushing the moving contact away from the fixed contact.

3. The electrical switch as claimed in claim 1, wherein the remover is supported for sliding movement to remove the moving contact from the fixed contact.

4. The electrical switch as claimed in claim 3, including a pivotal member provided between the actuator and the remover for pivoting by the actuator to slide the remover.

5. The electrical switch as claimed in claim 1, including a contact lever having a first end about which the lever is pivotably supported and an opposite second end supporting the moving contact, and the remover part is arranged to act upon the second lever end for removing the moving contact from the fixed contact.

6. The electrical switch as claimed in claim 5, wherein the remover part faces the moving contact as the fixed contact and is slidable in a direction perpendicular to the contact lever for hitting its second end to push the moving contact away from the fixed contact.

7. The electrical switch as claimed in claim 5, including a pivotal member provided between the actuator and the remover for pivoting by the actuator to move the remover, the pivotal member extending parallel to the contact lever.

8. The electrical switch as claimed in claim 5, including a pivotal lever having a first end for pivoting by the actuator and a second end for moving the remover, wherein the actuator includes a slider slidable by the actuator through a cam action, and the slider positioned between the first ends of the contact lever and the pivotal lever.

9. The electrical switch as claimed in claim 8, wherein the actuator includes an inclined slot through which the slider extends at right angles, such that the slider will be slid by the actuator through a cam action in a direction perpendicular to the direction in which the actuator moves.

10. The electrical switch as claimed in claim 1, wherein the resilient means comprises a first spring biassing the actuator towards its second position and a second spring biassing the moving contact away from the fixed contact.

11. The electrical switch as claimed in claim 1, being a normally-open pushbutton switch.

* * * * *